US006315378B1

(12) United States Patent
Yoshida

(10) Patent No.: US 6,315,378 B1
(45) Date of Patent: Nov. 13, 2001

(54) PRINTING APPARATUS AND PRINTING METHOD

(75) Inventor: Hajime Yoshida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/391,488

(22) Filed: Sep. 8, 1999

(30) Foreign Application Priority Data

Sep. 9, 1998 (JP) ..... 10-255800

(51) Int. Cl.[7] ..... B41J 2/01; B41J 2/51
(52) U.S. Cl. ..... 347/14; 347/171
(58) Field of Search ..... 347/14, 12, 13, 347/171

(56) References Cited

U.S. PATENT DOCUMENTS 4,313,124 1/1982 Hara .
4,345,262 8/1982 Shirato et al. .
4,459,600 7/1984 Sato et al. .
4,463,359 7/1984 Ayata et al. .
4,558,333 12/1985 Sugitani et al. .
4,723,129 2/1988 Endo et al. .
4,740,796 4/1988 Endo et al. .

*Primary Examiner*—Huan Tran
(74) *Attorney, Agent, or Firm*—Fitzpatrick, Cella, Harper & Scinto

(57) ABSTRACT

A printing apparatus and a printing method perform the steps of computing the shift value of each ejection port in accordance with the thermally-expanded width of a print head, dividing the shift value by a nozzle pitch, using the ejection port which number is minimum among ejection ports having the same integer value of the above quotient as a boundary position, using the print data printed at the boundary position as the logical sum between data for two consecutive ejection ports, and printing each of print data values for ejection ports having the same quotient integer value as the boundary position as the print data for an ejection port number obtained by adding the quotient integer value to the ejection port number of its own.

12 Claims, 8 Drawing Sheets

EVEN RASTER

ODD RASTER

PRINTING APPARATUS AND PRINTING METHOD

This application is based on patent application No. 10-255800 filed on Sep. 9, 1998 in Japan, the content of which is incorporated hereinto by reference.

BACKGROUND OF THE INVENTION

1. Field of the Invention

The present invention relates to a printing apparatus for performing printing by means of a print head provided with a plurality of printing elements and a printing method using the print head, and particularly to a printing apparatus and a printing method for performing printing by means of a long sized print head.

2. Description of the Prior Art

As computers and communication devices have recently spread, various types of printing apparatuses have also rapidly spread. An ink jet type, a heat transfer type, or a thermosensitive type of printing apparatus can be given as examples of such printing apparatuses. These types of printing apparatuses theoretically produce heat to a slight degree while performing printing. Then, because of the produced heat, a print head is subjected to thermal expansion and positions of ejection ports are changed due to the thermal expansion, and thereby, points of deposition of ejected ink droplets on a printing medium may deviate.

A print head used in a so-called serial ink-jet printing apparatus having been widely spread so far is a relatively short sized one and has tens to hundreds of ejection ports. Therefore, even if positions of the ejection ports are changed due to thermal expansion, the degree of this position change can be ignored because it is small compared with, for example, unevenness in manufacturing of print heads.

However, a configuration in which the number of ejection ports of a print head is increased and moreover, the arrangement density of the ejection ports is raised is used as a configuration for realizing a high-quality image and reducing printing time. In the case of this configuration, a print head becomes longer and thereby, a deviation of the deposit position of ink droplet due to thermal expansion tends to become large.

For example, in the case of a long sized print head mainly made of aluminum as a material for a base member or the like, having an ejection port arrangement density of 600 dpi and having an overall length of 12 inches, the number of ejection ports becomes 7,200.

In this case, the linear expansion degree of aluminum is shown by the change AL of length to a temperature change $\Delta t$. In the case of aluminum, $\Delta L/(\Delta t \cdot L)$ is equal to $23.1\times10^{-6}(\text{deg})^{-1}$.

Therefore, in the case of a print head having a length L, the change $\Delta L$ of the length when temperature changes by $\Delta t$ is shown by the following Equation:

$$\Delta L=23.1\times10^{-6}\times\Delta t\times L(\text{inch}).$$

Because the length L of the printing head of this example is equal to 12 (inch), $\Delta L/\Delta t$ is equal to 0.17 (nozzle pitch/deg).

When assuming the operating temperature of the printing head of this example ranges between 20° and 50° C., the temperature changes in a range of up to 30° C. and thereby, the maximum change of the head is shown by the following Equation:

$$\Delta L\max=4.99(\text{nozzle pitches}).$$

Therefore, the deposit position deviates approximately 5 nozzle pitches at an end of the print head.

It is preferable that the printing accuracy of a printing apparatus, that is, the deposit position deviation of the ink droplet, is kept smaller than a normal nozzle pitch from the viewpoint of the printing quality. However, as shown by the above example, the deviation of up to approximately 5 dots may occur in the case of the long sized print head in which ejection ports are arranged at a high density and the printing quality is extremely deteriorated in the above deviation range.

Moreover, in the case of a heat-transfer or a thermosensitive type of printing apparatus, the length of a print head tends to become large in order to improve the image quality and the printing speed; therefore, the same problem as in the case of the above-described ink jet type may occur.

SUMMARY OF THE INVENTION

An object of the present invention is to provide a printing apparatus and a printing method having a function for correcting a deviation of a deposit position due to thermal expansion of a print head under printing.

A printing apparatus using a printing head in which a plurality of printing elements are arranged to perform printing on a printing medium based on print data assigned to a plurality of printing elements comprises deviation calculating means for, for a plurality of printing elements, calculating a deviation amount in an arrangement direction of the plurality of printing elements based on a predetermined amount of print data, the deviation of printing elements being caused by thermal expansion of the printing head; and assigning means for, for each of a plurality of printing-element groups which are made by distinguishing the plurality of printing elements by respective predetermined deviation amounts as references on a basis of the deviation amount of each of the plurality of printing elements calculated by the deviation calculating means, shifting the print data to be assigned to other printing elements by an amount corresponding to the predetermined deviation amount of the printing element group and performing assignments of the shifted print data to the printing element in the group.

A printing method using a printing head in which a plurality of printing elements are arranged to perform printing on a printing medium based on print data assigned to a plurality of printing elements comprises a deviation calculating step for, for a plurality of printing elements, calculating a deviation amount in an arrangement direction of the plurality of printing elements based on a predetermined amount of print data, the deviation of printing elements being caused by thermal expansion of the printing head; and an assigning step for, for each of a plurality of printing-element groups which are made by distinguishing the plurality of printing elements by respective predetermined deviation amounts as references on a basis of the deviation amount of each of the plurality of printing elements calculated by the deviation calculating step, shifting the print data to be assigned to other printing elements by an amount corresponding to the predetermined deviation amount of the printing element group and performing assignments of the shifted print data to the printing element in the group.

By using the printing apparatus and printing method having the above configuration, for each of a plurality of printing-element groups which are made by distinguishing the plurality of printing elements by respective predetermined deviation amounts as references on a basis of the deviation amount of each of the plurality of printing elements calculated by the deviation calculating means, the print data to be assigned to other printing elements is shifted by an amount corresponding to the predetermined deviation amount of the printing element group and assignments of the shifted print data to the printing element in the group are performed. Thereby, it is possible to keep the deviation from the ideal position of the dot at a predetermined deviation value or less when performing printing. For example, in the case when a predetermined deviation value is equal to a nozzle pitch, it is possible to suppress a dot deviation to one dot or less.

The above and other objects, effects, features and advantages of the present invention will become more apparent from the following description of embodiments thereof taken in conjunction with the accompanying drawings.

DESCRIPTION OF THE PREFERRED EMBODIMENTS

A printing apparatus and a printing method to which the present invention is applied will be described below by referring to the accompanying drawings.

Figure 1:
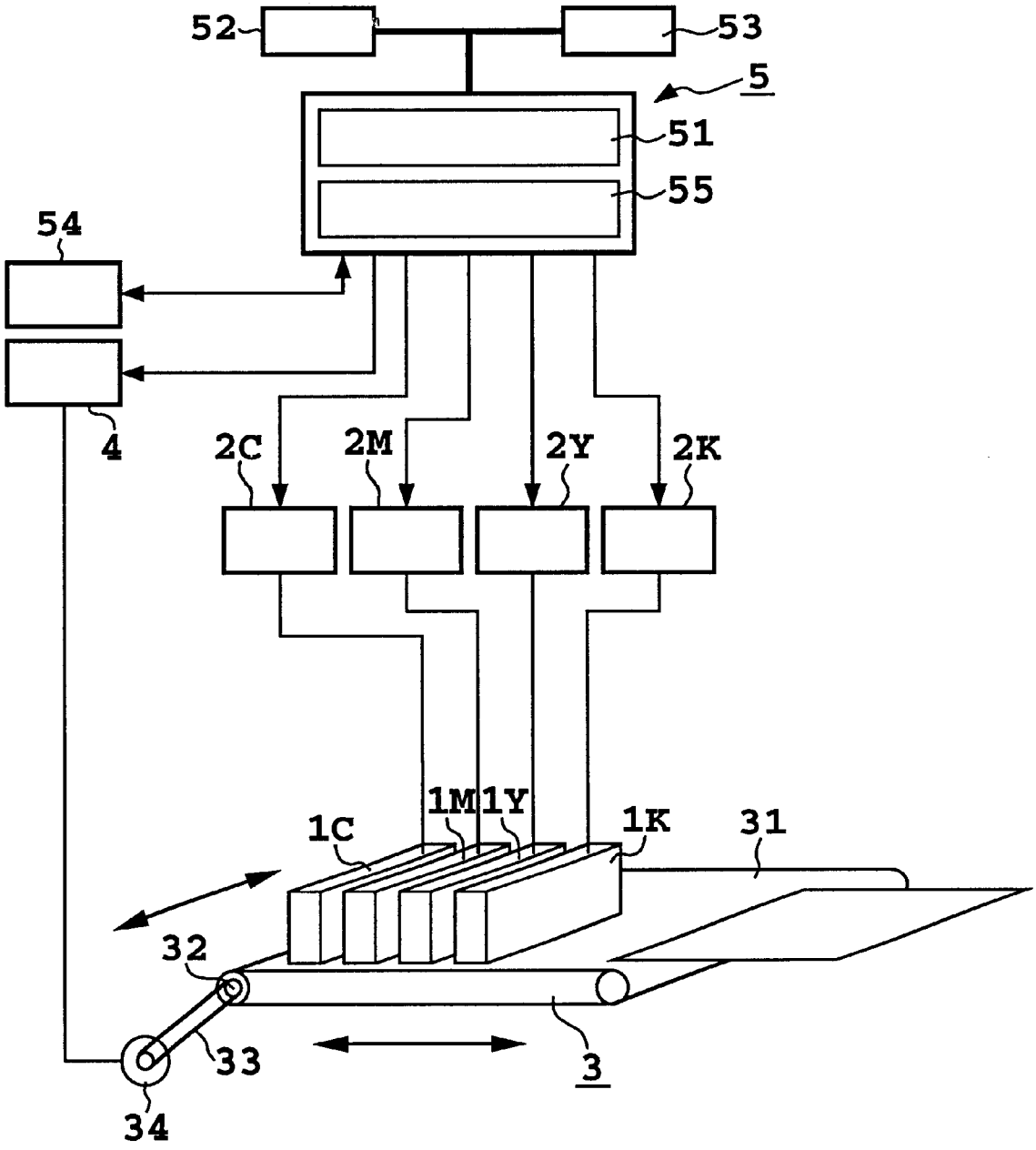
FIG. 1 is a schematic block diagram of a printing apparatus of the present invention.

FIG. 1 is a block diagram of a printing apparatus to which the present invention is applied.

The printing apparatus is provided with print heads 1C, 1M, 1Y, and 1K for discharging cyan ink, magenta ink, yellow ink, and black ink, head driving circuits 2C, 2M, 2Y, and 2K for supplying print data to the print heads, a sheet carrying mechanism 3 for carrying a printing medium such as a sheet to the printing position by each print head, a mechanism driving circuit 4 for controlling elements of the sheet carrying mechanism 3 and driving of the print heads 1, and a control circuit 5 for synthetically controlling the circuits.

The total of 7,200 ejection ports are arranged in a line at a rate of 600 ports/inch on each of the print heads 1C, 1M, 1Y, and 1K. Moreover, the print heads 1 are each provided with an ink tank (not illustrated) for supplying ink and the ink tank connects with the ejection ports through an ink channel. Moreover, a heater is provided in the ink channel correspondingly for each ejection port. To eject ink, the heater is operated to produce bubbles in the ink and eject ink droplets by the bubble producing pressure. Furthermore, an ink-droplet discharging method is not restricted to the above bubble jet method but it is also possible to use other methods.

The sheet carrying mechanism 3 is provided with a sheet feed belt 31, a belt pulley 32, a motor belt 33, and a motor 34. Each portion is driven in accordance with the control by the mechanism driving circuit 4 to carry a printing medium.

The control circuit 5 is provided with a central processing unit (CPU) 51, a ROM 52 for storing the control procedure of each mechanism, a RAM 53 for temporarily storing data, an NVRAM 54 capable of holding data even when a power supply is disconnected, a sensor (not illustrated) for detecting the information for peripheral environment or the like, an input/output section 55 for incorporating data from the sensor, and sending control information to the mechanism driving circuit 4 or the like, and an interface circuit (not illustrated) for communicating with an external unit or a peripheral electric circuit.

EMBODIMENT 1

As for the printing apparatus having the above configuration, a method for correcting the deviation of a dot, which correction is a feature of a printing method to which the present invention is applied, will be described below.

As a premise of the above correction, data with respect to thermal expansion of a print head is previously input to the printing apparatus when the apparatus is manufactured. The data is obtained by actually measuring the thermal expansion of the head. In order to measure the thermal expansion, the print head is heated by supplying current to the print head at an amount that no ink droplet is ejected and a change in a temperature and in a length of the print head caused by the heating are measured. It should be noted that a print-head heating method is not restricted to the above method. It is also possible to use other methods of providing a heater in the print head to heat the head. After the measurement, data representing a temperature change of the print head with respect to electric power supplied to the print head during unit time and data representing an overall-length change of the print head with respect to the electric power supplied to the print head during unit time are produced, based on a result of the above measurement. Here, the temperature change is given as a changed amount from the normal temperature and the overall-length change is given as a changed amount from an overall-length of the print head in a condition before the head is driven and in a condition of the normal temperature. The normal temperature and the overall-length of the print head at the normal temperature are set to be respective reference values. Further, the number of ejection ports to be driven during unit time is obtained from a print data amount to be processed in the print head during unit time and an electric power for unit time is obtained from the number of ejection ports. Then, the above-stated temperature change and the above-stated overall-length change can be obtained with respect to the print data amount. Thus obtained respective relations between the print data amount and the respective temperature change and overall-length change are set as table data, and the table data is previously stored in the ROM 52 of the control circuit 5 when manufacturing the apparatus.

Correction of the dot deviation performed by the control circuit 5 using the above-described temperature change data and overall-length change data will be described below.

It should be noted that the processing described below is performed separately for the respective print heads 1C, 1M, 1Y, and 1K. Therefore, in the description below, the print heads are indicated by reference numeral 1.

Figure 2:
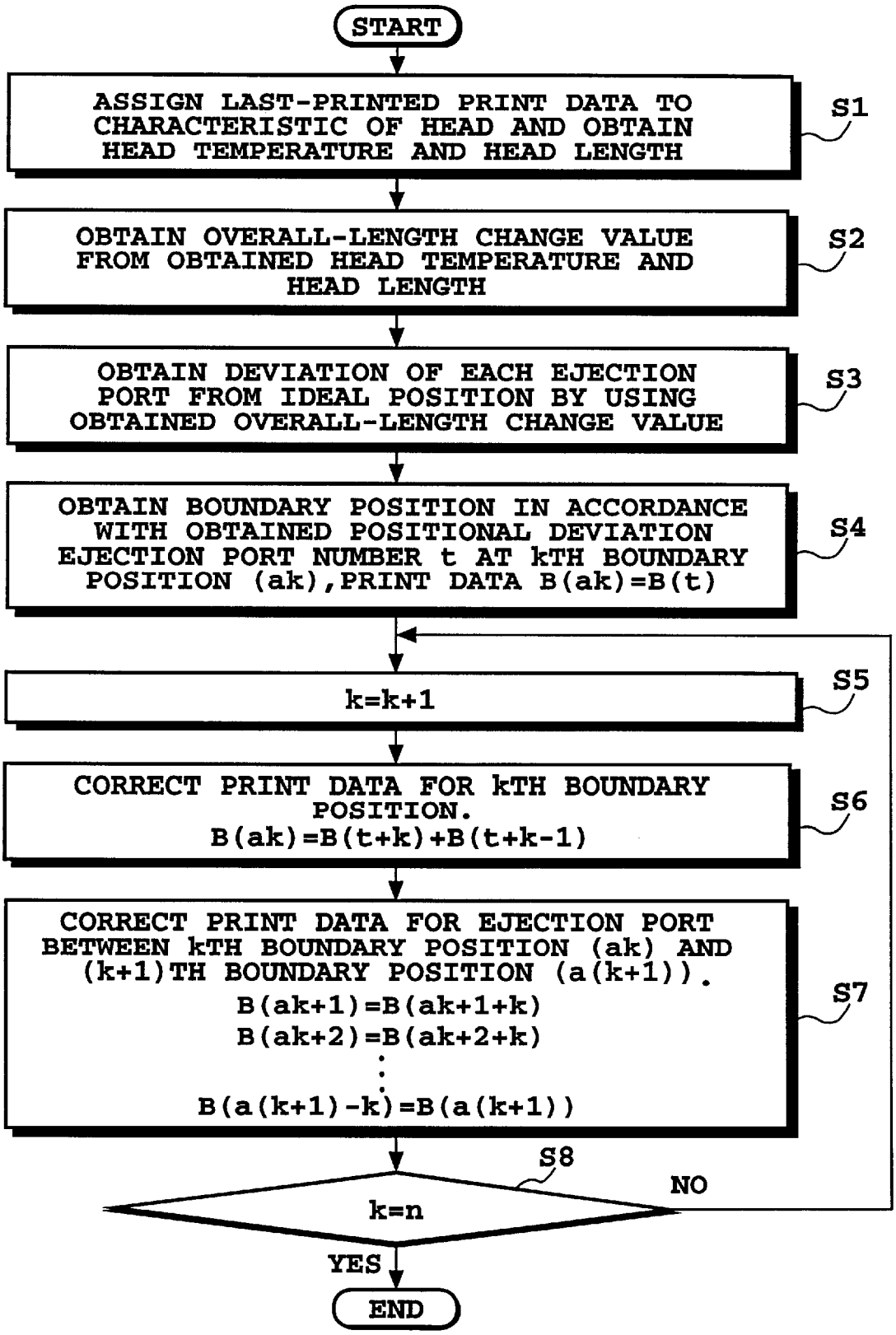
FIG. 2 is a flow chart showing shift processing.

FIG. 2 is a flow chart showing a procedure for correcting the dot deviation.

The procedure is initiated at every termination of printing of one page.

First, the print data amount which was supplied to the print head 1 during a last printing operation is obtained on a basis of the print data (for one page) used for the last printing operation. Then, the table in the ROM 52 of the control circuit 5 is referred to by means of the obtained print data amount to obtain the temperature change and the overall-length change. Further, the head temperature and the length of the head after being expanded are obtained by adding the respective reference values to the temperature change and the overall-length change (step 1). It is assumed that the length change of the print head 1 is uniform over the overall length of the head.

The overall-length change value of the print head 1 is obtained from the obtained head temperature and head length (step 2).

Then, a shift of each ejection port from the ideal position is obtained from the following Equations 1 and 2 (step 3). In this case, it is assumed that each ejection port is provided with an ejection port number from one end to the other end of the print heads 1 in order to distinguish between the ejection ports.

Present position of ejection port=Ideal position+(overall-length change value/number of ejection ports)×ejection port number (Equation 1)

Positional shift of ejection port (nozzle)=present position of ejection port−Ideal position (Equation 2)

Then, it is assumed that the minimum ejection port number among the ejection ports whose positional deviations are equal to or greater than one nozzle pitch is a first boundary position (a1).

It is assumed that the minimum ejection port number among the ejection ports whose positional deviations are equal to or greater than two nozzle pitches is a second boundary position (a2). Thus, when positional deviations are 3 nozzle pitches, 4 nozzle pitches, . . . and n nozzle pitches, boundary positions are similarly decided (step 4). Decided boundary positions are stored in the RAM 53 as boundary positions for the number of data shifts for the next-time printing.

Figure 3:
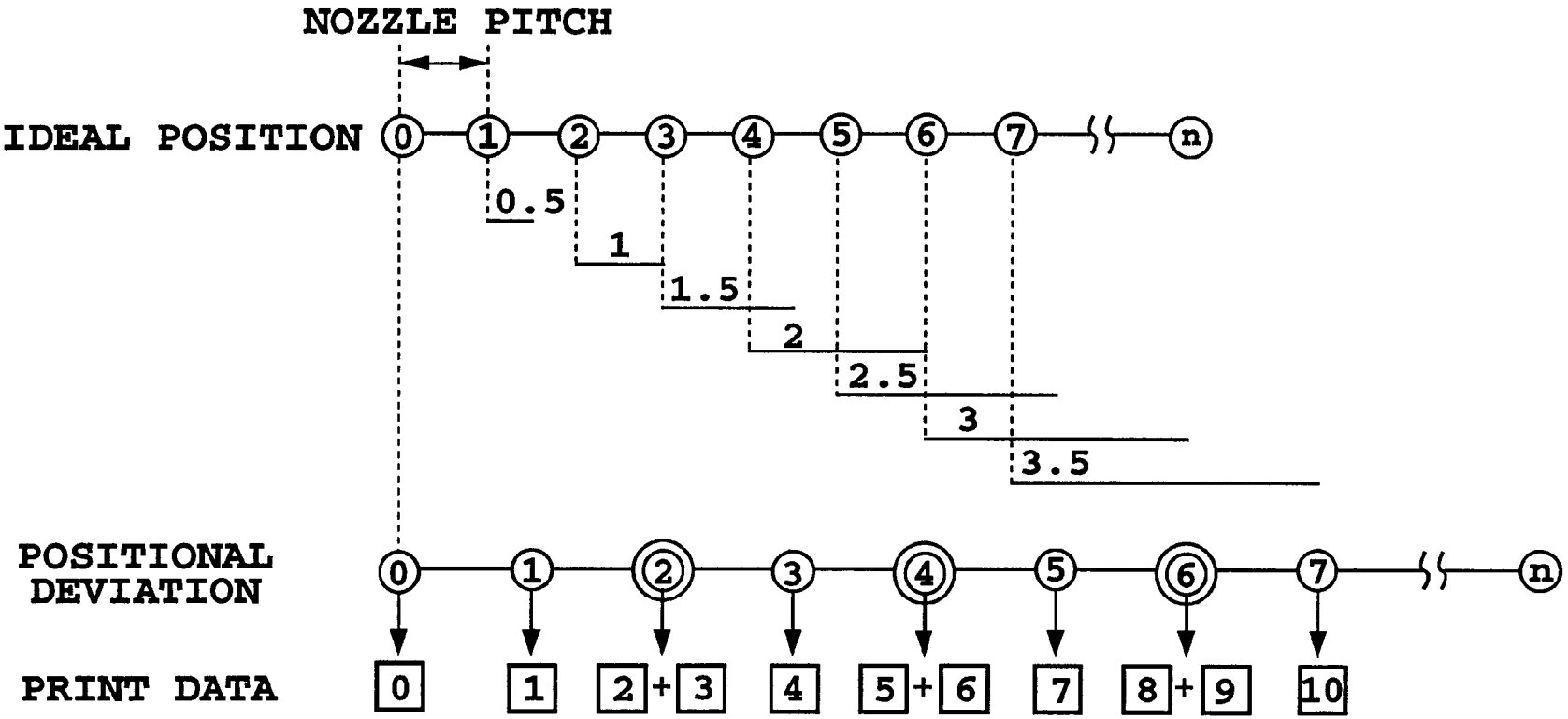
FIG. 3 is an illustration showing deviation ranges of an ejection port of embodiment 1.

As shown in FIG. 3, when, for example, there are positional deviations such as a positional deviation of 0.5 nozzle pitch for the first ejection port, a positional deviation of 1 nozzle pitch for the second ejection port, . . . , an ejection port number corresponding to each boundary position is shown as follows:

First boundary position (a1)=2

Second boundary position (a2)=4

Third boundary position (a3)=6 . . .

That is, it is possible to consider that the integer part for the nozzle pitch showing the positional deviation of an ejection port corresponding to the kth boundary position becomes k.

Then, correction of print data for each ejection port will be described below in accordance with the boundary positions obtained as described above. The following processing is performed for each boundary position (step 5).

It is assumed that the print data for the ejection port at the kth boundary position is equal to the logical sum between the print data for the ejection port number obtained by adding k to the ejection port number at the kth boundary position and the print data for the ejection port number obtained by adding (k−1) to the ejection port number at the kth boundary position (step 6).

The print data for an ejection port between the kth boundary position and the (k+1)th boundary position is shifted to a smaller ejection port number by the integer of a positional deviation, that is k (step 7).

A detailed processing procedure according to the above correction rule will be shown below. In this case, it is assumed that the print data for the ejection port (0) is equal to B(0).

First, the print data values B(0) to B(a1−1) from the ejection port (0) up to immediately before the first boundary position (a1) are not corrected but it is assumed that they are directly used as the print data of corresponding ejection ports.

Then, it is assumed that the print data B(a1) for the first boundary position (a1) is shown by the following Equation.

$$B(a1)=B(a1)+B(a1+1)$$

That is, it is assumed that the logical sum between the print data (a1) and the print data B(a1+1) for the ejection port (a1+1) adjacent to the first boundary position (a1) is equal to B(a1).

Moreover, all print data of the ejection port before the second boundary position (a2) from the ejection port (a1+2) downward are shifted one by one starting with the smallest ejection port number.

$$B(a1+1)=B(a1+2)$$
$$B(a1+2)=B(a1+3)$$
$$B(a1+3)=B(a1+4)$$
$$\vdots$$
$$B(a2-1)=B(a2)$$

It is assumed that the logical sum between the print data for the ejection port (a2+1) immediately after the second boundary position (a2) and the print data for the ejection port (a2+2) adjacent to the ejection port (a2+1) is equal to the print data for the second boundary position (a2).

$$B(a2)=B(a2+1)+B(a2+2)$$

Moreover, all print data values from the ejection port (a2+3) up to the ejection port (a3+1) immediately after the third boundary position (a3) are shifted two by two starting with the smallest ejection port number.

$$B(a2+1)=B(a2+3)$$
$$B(a2+2)=B(a2+4)$$
$$B(a2+3)=B(a2+5)$$
$$\vdots$$
$$B(a3-1)=B(a3+1)$$

Hereafter, the print data values from the third boundary position (a3) downward are shifted in accordance with the correction rule. This processing is repeated up to the last ejection port of the print head (up to the ejection port number n for this embodiment) or up to the last raster data to be printed (step 8). Thus, the shifted print data is printed. It is assumed that the above shifting is performed every page whenever the printing for one page is completed.

In case of the example shown in FIG. 3, the data shifting shown by a numeric character enclosed by a quadrangle in FIG. 3 is applied to print data by applying the above correction rule.

Thus, by printing the data-shifted print data, it is possible to control the deviation of a dot to one dot or less.

EMBODIMENT 2

Though a method for deciding a boundary position is the same as the case of the embodiment 1, the embodiment 2 processes data every two rasters. That is, each raster is provided with a raster number, a raster with an even raster number is assumed as an even raster and a raster with an odd raster number is assumed as an odd raster, and rasters are processed by assuming an even raster and an odd raster as one set.

The processing is specifically described below by referring to the flow chart in FIG. 2. This embodiment is the same as the embodiment 1 up to the part of deciding the boundary position in step 4. From step 5 downward, however, the processing applied to even rasters is different from the processing applied to odd rasters.

First, as for even rasters, print data values B(a1−1) from the top ejection port up to immediately before the first boundary position (a1) are not shifted similarly to the case of the embodiment 1.

The logical sum between the print data B(a1) for the first boundary position (a1) and the print data B(a1+1) for the next ejection port is used as new print data for the first boundary position (a1).

$$B(a1)=B(a1)+B(a1+1)$$

Moreover, the print data of the ejection port before the second boundary position (a2) are shifted to a smaller ejection port number one by one.

$$\begin{aligned} B(a1+1) &= B(a1+2) \\ B(a1+2) &= B(a1+3) \\ B(a1+3) &= B(a1+4) \\ &\vdots \\ B(a2-1) &= B(a2) \end{aligned}$$

Then, the logical sum between the print data B(a2+1) for the ejection port (a2+1) next to the second boundary position (a2) and the print data B(a2+2) for the next ejection port is used as new print data for the second boundary position (a2).

$$B(a2)=B(a2+1)+B(a2+2)$$

Moreover, print data of the ejection port before the third boundary position (a3) are shifted to a smaller ejection port number two by two.

$$\begin{aligned} B(a2+1) &= B(a2+3) \\ B(a2+2) &= B(a2+4) \\ B(a2+3) &= B(a2+5) \\ &\vdots \\ B(a3-1) &= B(a3+1) \end{aligned}$$

Hereinafter, the print data values from the third boundary position (a3) downward are shifted similarly to the embodiment 1. This processing is repeated up to the last ejection port of the print head (up to the ejection port number n for this embodiment) or up to the last raster data to be printed (step 8).

When there is the positional deviation shown in FIG. 4A, an ejection port number corresponding to each boundary position is shown below.

First boundary position (a1)=2

Second boundary position (a2)=4

Third boundary position (a3)=6 . . .

Figure 4A:
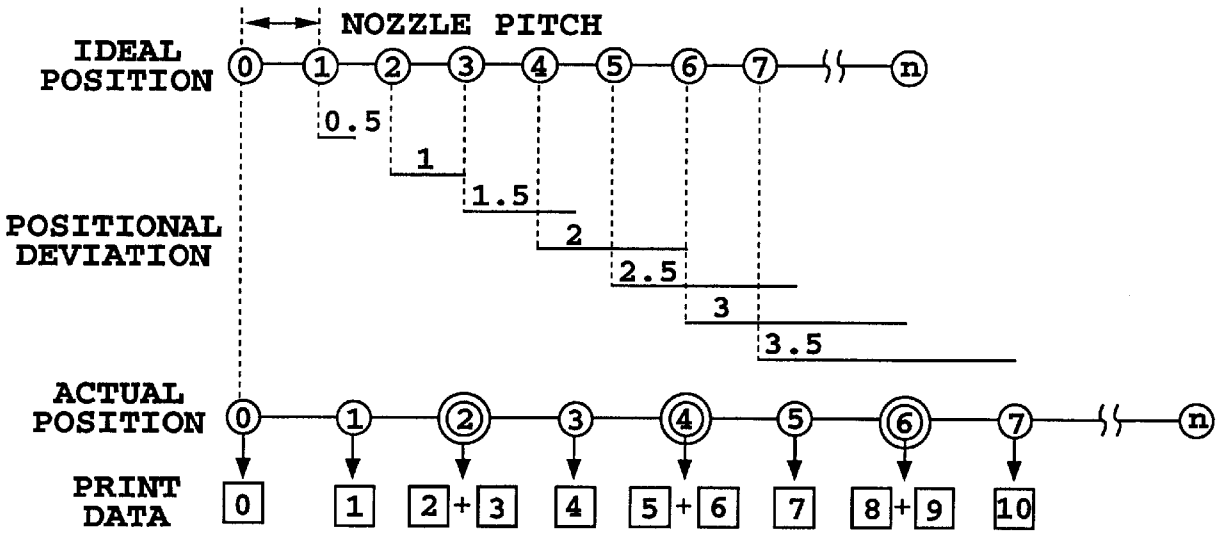
FIG. 4A is an illustration showing deviation ranges of an ejection port for even rasters of embodiment 2.

Each shifted print data of the ejection port corresponds to a ejection port number with a numeric character enclosed by a quadrangle in FIG. 4A.

As for odd rasters, the following data shifting is performed.

First, the print data B(a1−2) from the top ejection port up to the last ejection port but one before the first boundary position (a1) are not shifted similarly to the case of even rasters.

Then, the print data for the ejection port (a1−1) is replaced with the logical sum with the print data for the first boundary position (a1).

$$B(a1-1)=B(a1-1)+B(a1)$$

Moreover, print data from the ejection port (a1+1) up to the ejection port (a2−1) immediately before the second boundary position (a2) are shifted to a smaller ejection port number one by one.

$$\begin{aligned} B(a1) &= B(a1+1) \\ B(a1+1) &= B(a1+2) \\ B(a1+2) &= B(a1+3) \\ &\vdots \\ B(a2-2) &= B(a2-1) \end{aligned}$$

Then, the logical sum between the print data for the second boundary position (a2) and the print data for the next ejection port (a2+1) is assumed as the print data for the ejection port (a2−1).

$$B(a2-1)=B(a2)+B(a2+1)$$

Moreover, all print data values from the ejection port (a2+2) before to the third boundary position (a3) are shifted to a smaller ejection port number two by two.

$$\begin{aligned} B(a2) &= B(a2+2) \\ B(a2+1) &= B(a2+3) \\ B(a2+2) &= B(a2+4) \\ &\vdots \\ B(a3-2) &= B(a3) \end{aligned}$$

Then, print data values from the third boundary position (a3) downward are similarly shifted. This processing is repeated up to the last ejection port (up to the ejection port number n in the case of this example) or the last raster data to be printed.

Figure 4B:
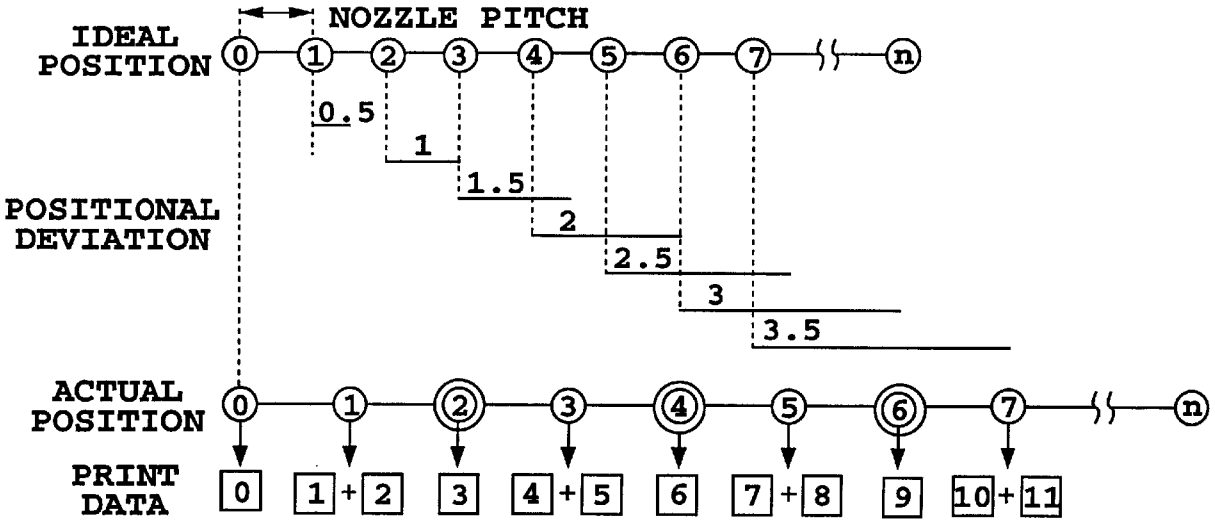
FIG. 4B is an illustration showing deviation ranges of an ejection port for odd rasters of embodiment 2.

When there is the positional shift shown in FIG. 4B, an ejection port number corresponding to each boundary position is shown below.

First boundary position (a1)=2

Second boundary position (a2)=4

Third boundary position (a3)=6 . . .

Thus, print data with ejection port numbers 1, 3, 5, and 7 serve as the logical sum between two adjacent print data.

That is, the logical sum between print data for adjacent ejection ports is used as the print data for a boundary position in the case of even rasters while the logical sum between print data for adjacent ejection ports is used not as the print data for a boundary position but as the print data for an ejection port with an ejection port number immediately before the boundary position in the case of odd rasters.

The print data for each ejection port is divided into two cases such as "to be printed" and "not to be printed". Therefore, when print data is shifted by a value equivalent to the integer of a positional deviation, the probability for an ejection port corresponding to the print data to perform printing is equal to ½, while the probability for an ejection port corresponding to the logical sum between print data values for adjacent ejection ports to perform printing is equal to ¾. Therefore, as described for the embodiment 1, when always printing the logical sum between print data values at a boundary position, the printing load of an ejection port serving as a boundary position increases compared to that of other ejection ports. Therefore, in the case of this embodiment, it is possible to reduce the printing load of an ejection port at a boundary position because ejection ports for printing the logical sum between print data values are changed by shifting print data for producing a logical sum for even rasters and odd rasters.

EMBODIMENT 3

A method for processing data every n rasters will be described below as a modification obtained by improving the embodiment 2.

First, a boundary position is decided in accordance with the flow up to step 4 of the flow chart shown in FIG. 2 similarly to the case of the embodiments 1 and 2.

Then, serial raster numbers after printing is started are assumed as N (N=0, 1, 2, 3, . . . ) and a remainder when dividing N by the number of processing-raster units n is assumed as m.

As for a raster in which m equals 0, print data from the top ejection port up to the ejection port immediately before the first boundary position (a1) are not shifted.

Then, the logical sum between the print data for the first boundary position (a1) and the print data for the ejection port (a1+1) adjacent to the first boundary position (a1) is assumed as the print data for the first boundary position (a1).

$$B(a1)=B(a1)+B(a1+1)$$

Moreover, print data of the ejection port before the second boundary position (a2) are shifted to a smaller ejection port number one by one.

$$\begin{aligned} B(a1+1) &= B(a1+2) \\ B(a1+2) &= B(a1+3) \\ B(a1+3) &= B(a1+4) \\ &\vdots \\ B(a2-1) &= B(a2) \end{aligned}$$

The logical sum between the ejection port (a2+1) next to the second boundary position (a2) and the ejection port (a2+2) is assumed as the print data for the second boundary position (a2).

$$B(a2)=B(a2+1)+B(a2+2)$$

Moreover, all print data of the ejection port up to the ejection port (a3+1) next to the third boundary position (a3) are shifted to a smaller ejection port number two by two.

$$\begin{aligned} B(a2+1) &= B(a2+3) \\ B(a2+2) &= B(a2+4) \end{aligned}$$

-continued $$\begin{aligned} B(a2+3) &= B(a2+5) \\ &\vdots \\ B(a3-1) &= B(a3+1) \end{aligned}$$

Hereafter similarly, data shifting is repeated up to the last ejection port of a print head or the last print data for rasters.

As for a raster in which m equals 1, print data from the top ejection port up to the last ejection port (a1−2) but one before the first boundary position (a1) are not shifted.

The logical sum between the print data values B(a1−1) and B(a1) is used as new B(a1−1).

$$B(a1-1)=B(a1-1)+(a1)$$

Moreover, print data of the ejection port up to (a2−1) immediately before the second boundary position (a2) are shifted to a smaller ejection port number one by one.

$$\begin{aligned} B(a1) &= B(a1+1) \\ B(a1+1) &= B(a1+2) \\ B(a1+2) &= B(a1+3) \\ &\vdots \\ B(a2-2) &= B(a2-1) \end{aligned}$$

The logical sum between the print data B(a2) for the second boundary position (a2) and the print data B(a2+1) for the next ejection port (a2+1) is used as new print data B(a2−1).

$$B(a2-1)=B(a2)+B(a2+1)$$

Moreover, all print data of the ejection port before the third boundary position (a3) are shifted to a smaller ejection port number two by two.

$$\begin{aligned} B(a2) &= B(a2+2) \\ B(a2+1) &= B(a2+3) \\ B(a2+2) &= B(a2+4) \\ &\vdots \\ B(a3-2) &= B(a3) \end{aligned}$$

Hereafter similarly, data shifting is repeated up to the last ejection port of a print head or the last print data for rasters.

Such a processing is repeated.

As for a raster in which m equals n−1, print data values from the top ejection port (0) up to the ejection port (a1−n) n ports before the first boundary position (a1) are not shifted.

The print data for the ejection port (a1−n+1) n−1 ports before the first boundary position (a1) is shown by the following Equation.

$$B(a1-n+1)=B(a1-n+1)+B(a1-n+2)$$

Moreover, all print data from the next ejection port (a1−n+3) up to (a2−n) n ports before the second boundary position (a2) are shifted to a smaller positional value one bit by one bit.

$$B(a1-n+2) = B(a1-n+3)$$

-continued $$B(a1-n+3)=B(a1-n+4)$$

$$B(a1-n+4)=B(a1-n+5)$$

$$\vdots$$

$$B(a2-n-1)=B(a2-n)$$

The logical sum between the print data B(a2−n+1) (n−1) data before the second boundary position (a2) and the print data B(a2−n+2) for the adjacent next ejection port is used as new print data B(a2−n+1).

$$B(a2-n+1)=B(a2-n+1)+B(a2-n+2)$$

Moreover, all print data values from the next ejection port (a2−n+3) up to the third boundary position (a3) are shifted to a smaller ejection port number two by two.

$$B(a2)=B(a2+2)$$

$$B(a2+1)=B(a2+3)$$

$$B(a2+2)=B(a2+4)$$

$$\vdots$$

$$B(a3-2)=B(a3)$$

Hereafter similarly, data shifting is repeated up to the last ejection port of a head or the last print data for rasters.

Thus, by shifting an ejection port for printing the logical sum between adjacent print data every raster, it is possible to moderate that a printing load deviates to a certain ejection port.

EMBODIMENT 4

Figure 5:
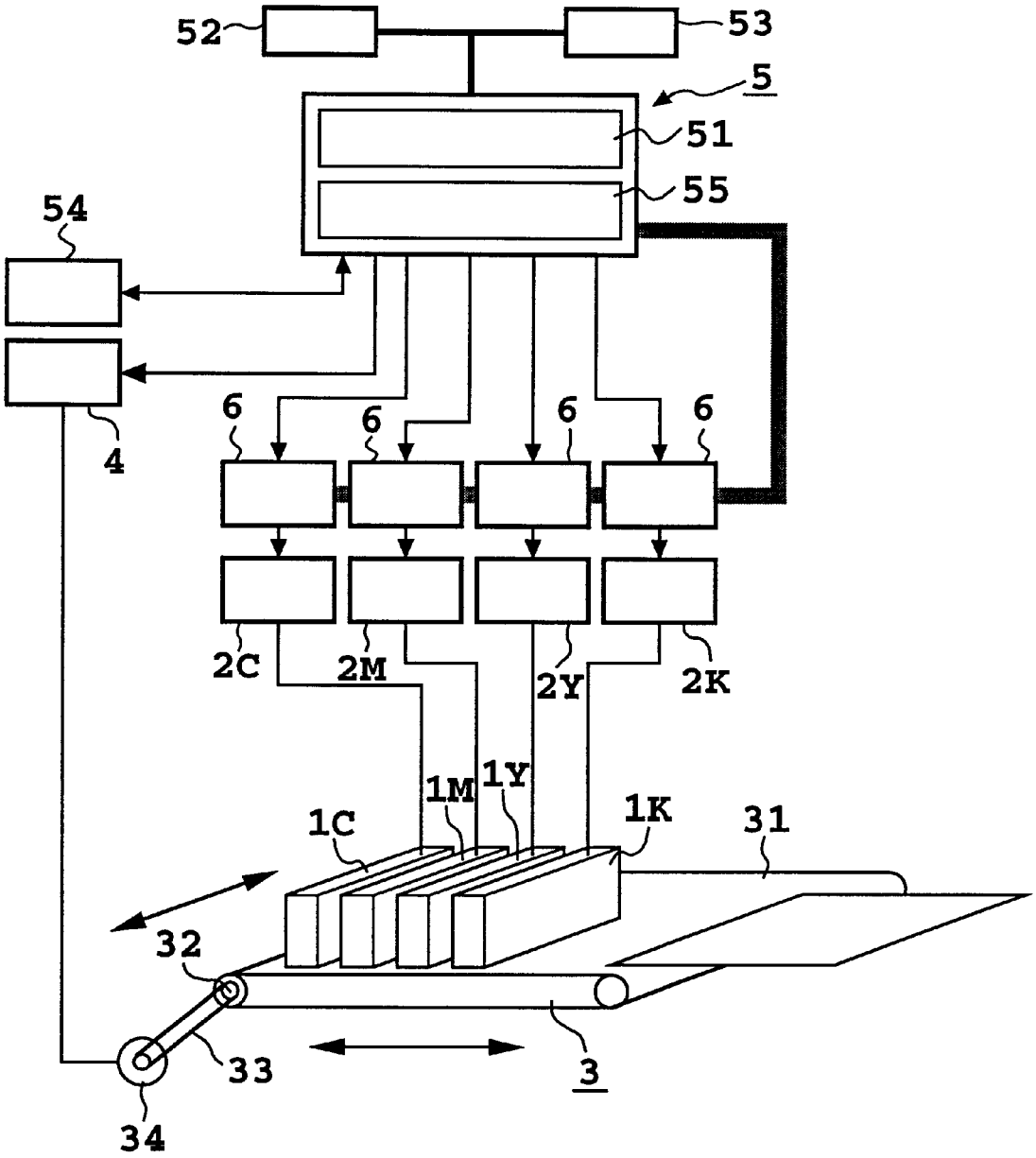
FIG. 5 is a schematic block diagram of another embodiment of a printing apparatus of the present invention.

As shown in FIG. 5, this embodiment makes data pass through an address shift circuit 6 before transferring the data to a print head.

Figure 6:
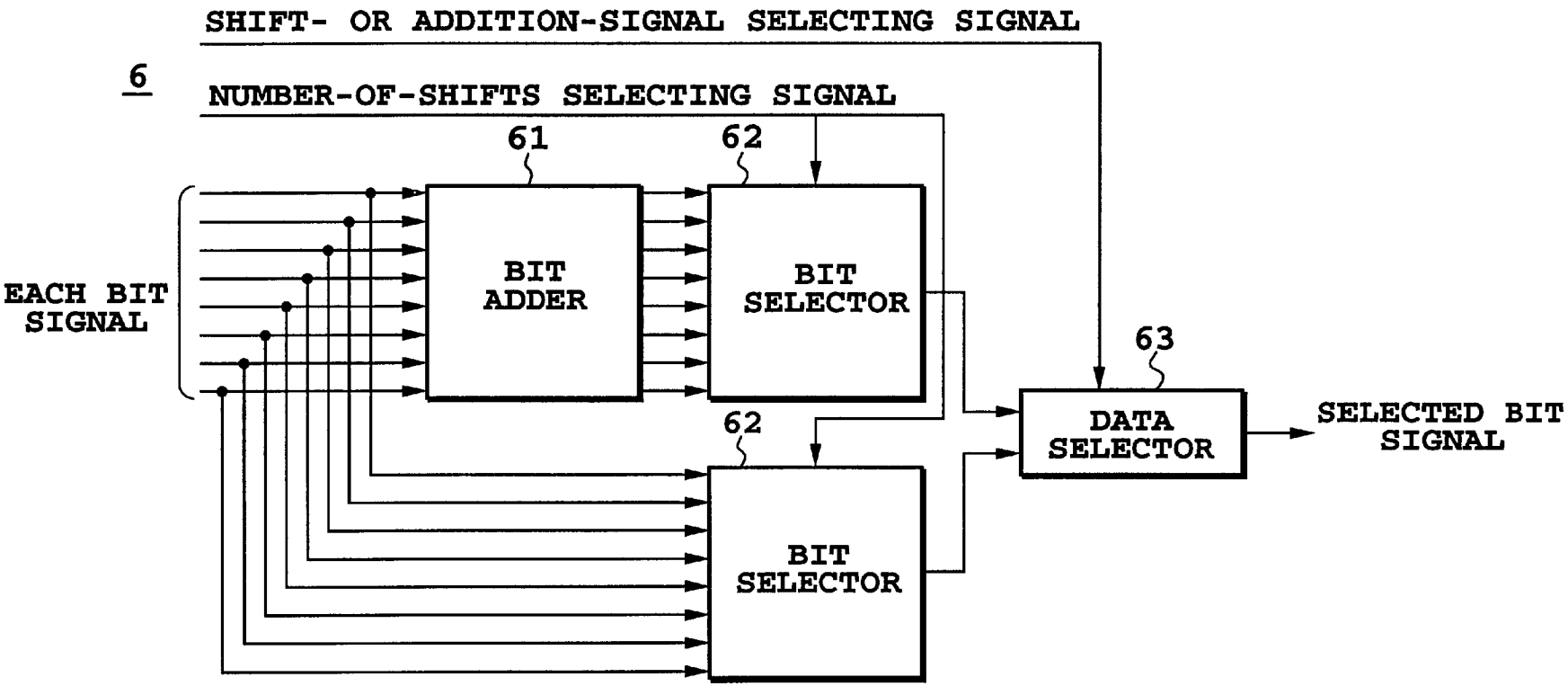
FIG. 6 is a block diagram of an address shift circuit.
Figure 7:
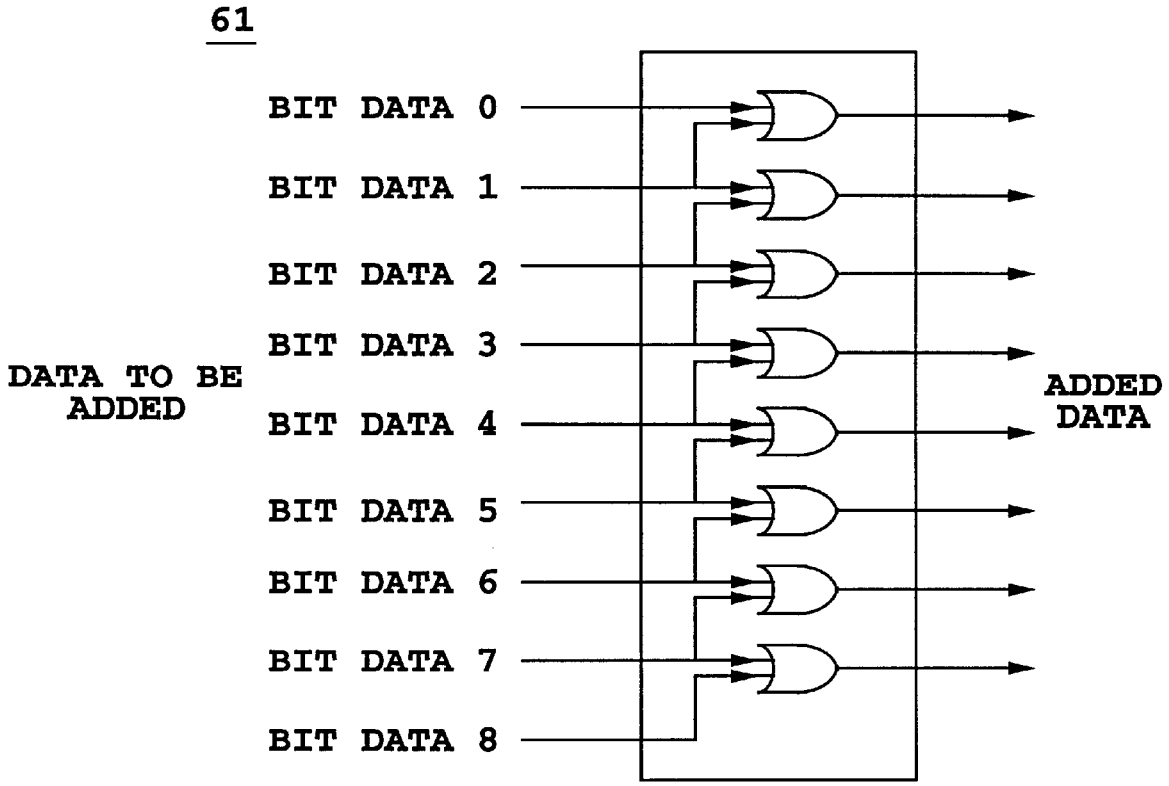
FIG. 7 is a block diagram of a bit adder.
Figure 8:
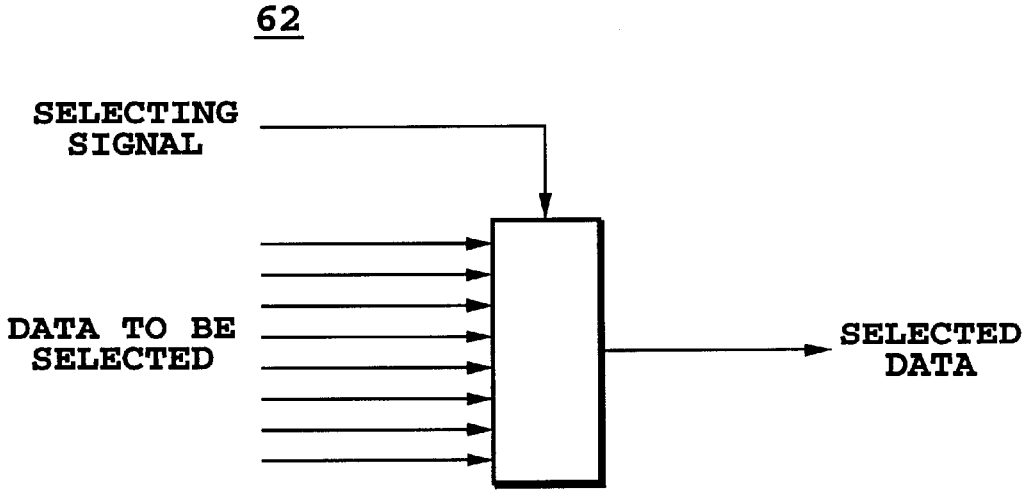
FIG. 8 is a block diagram of a bit selector.
Figure 9:
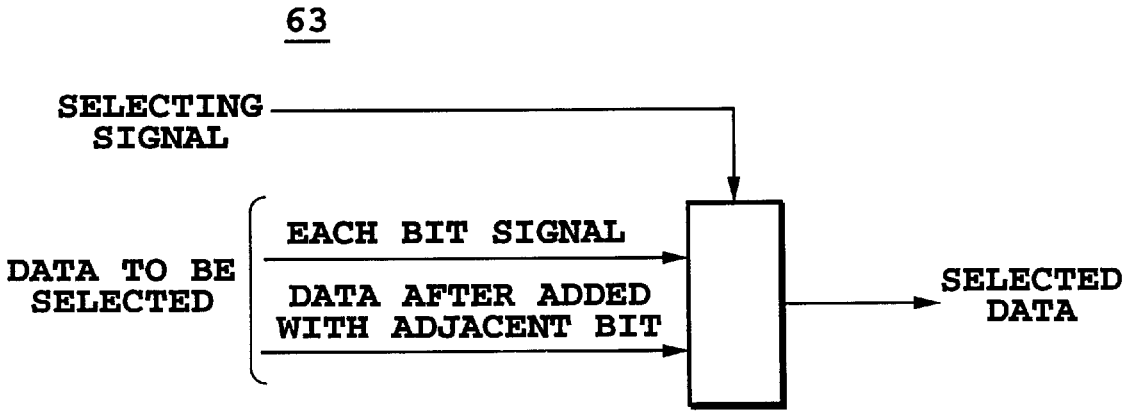
FIG. 9 is a block diagram of a data selector.

As shown in FIG. 6, the address shift circuit 6 is configured by a bit adder 61, a bit selector 62, and a data selector 63. As shown in FIG. 7, the bit adder 61 is calculating means for calculating the logical sum between a single bit and the next bit adjacent to the single bit among eight bit signals. As shown in FIG. 8, the bit selector 62 is selecting means for selecting a single bit out of eight bit signals. As shown in FIG. 9, the data selector 63 is data selecting means for selecting either of a bit selector output and a bit adder output.

It is assumed that a plurality of bit signals to be input respectively have three bits before and after a reference position. Each of these electric circuits is prepared for every ejection port.

A control method will be described below.

A boundary-position deciding method and a data shifting method are the same as the case of the embodiment 1 previously described. However, though data is shifted by a control section 5 in case of the embodiments 1, 2, and 3, data is shifted by operating the address of data by the address shift circuit 6 in this embodiment. The operating method will be described below.

Because no bit is moved from the top ejection port up to the ejection port immediately before a first boundary position (a1), the bit adder 61 is not operated. The bit selector 62 selects the bit at the reference position and the data selector 63 selects the bit selector side.

Because the logical sum with the bit data for the next ejection port is used for the first boundary position (a1), the bit adder 61 selects the logical sum between the bit at the reference position, that is, the first boundary position (a1) and the next bit. The bit selector 62 is not operated. The data selector 63 selects the bit adder side.

Because bit data values from an ejection port (a1+1) next to the first boundary position (a1) up to the ejection port immediately before a second boundary position (a2) are shifted to a smaller ejection port number one by one, the bit adder 61 is not operated. The bit selector 62 selects a bit obtained by adding +1 to the reference position. The data selector 63 selects the bit selector side.

The bit adder 61 selects the logical sum between the bit obtained by adding +1 to the reference position and the next bit for a second boundary position (a2). The bit selector 62 is not operated. The data selector 63 selects the bit adder side.

Hereafter similarly, selection of output data for ejection ports is repeated up to the last ejection port of a print head or the last print data.

Thus, by shifting data not by the control section 5 but by the address shift circuit 6, it is possible to operate not data but addresses and thereby, it is possible to reduce the time required for processing.

For the embodiments 1, 2, 3, and 4, the ink jet type is described as an example. However, it is a matter of course to apply any one of the embodiments to other types of printing apparatuses.

Moreover, each of the above embodiments can be applied not only to a monochromatic printing apparatus having a single head but also to a multicolor printing apparatus having a plurality of heads. In this case, when print heads to be used are similarly manufactured, it is possible to consider that thermal expansion and contraction characteristics of the print heads are the same. In this case, it is permitted to measure thermal expansion and contraction characteristics at the preparation stage for not each print head but for the print heads similarly manufactured in common. Moreover, it is possible to apply the measurement results to each print head. As a result, the positional shift of the nozzle of each print head from an ideal position can be controlled to one dot or less. Moreover, it is possible to control the positional shift between print heads to two dots or less.

By using an ink-jet printing apparatus of the present invention, it is possible to control a printing-position deviation to predetermined nozzle pitches or less (e.g. 1 nozzle pitch) because data is printed while being shifted in accordance with the expansion of a print head.

Because the above data shifting is performed by only software and an electric circuit without using any data-shifting machine, it is possible to obtain an image improvement effect without increasing a mechanical cost.

Moreover, by performing data shifting in accordance with not data operation but address operation, it is possible to reduce the time required for processing.

As described in the respective embodiments, it is desirable in the view of precision that calculating a deviation is performed for each ejection port. However, it may be possible in the view of simplification of the calculation that calculating the deviation is performed for every predetermined number of ejection ports, for example, every two ejection ports. That is, the calculating may be performed for each even numbered ejection port.

The present invention achieves distinct effect when applied to a printing head or a printing apparatus which has means for generating thermal energy such as electrothermal transducers or laser light, and which causes changes in ink by the thermal energy so as to eject ink. This is because such a system can achieve a high density and high resolution printing.

A typical structure and operational principle thereof are disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces sudden temperature rise that exceeds the nucleate boiling so as to cause the film boiling on heating portions of the printing head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a printing head, which is incorporated into the present invention: this structure includes heating portions disposed on bent portions in addition to a combination of the ejection orifices, liquid passages and the electrothermal transducers disclosed in the above patents.

The present invention can be also applied to a so-called full-line type printing head whose length equals the maximum length across a printing medium. Such a printing head may consist of a plurality of printing heads combined together, or one integrally arranged printing head.

In addition, the present invention can be applied to various serial type printing heads: a printing head fixed to the main assembly of a printing apparatus; a conveniently replaceable chip type printing head which, when loaded on the main assembly of a printing apparatus, is electrically connected to the main assembly, and is supplied with ink therefrom; and a cartridge type printing head integrally including an ink reservoir.

It is further preferable to add a recovery system, or a preliminary auxiliary system for a printing head as a constituent of the printing apparatus because they serve to make the effect of the present invention more reliable. Examples of the recovery system are a capping means and a cleaning means for the printing head, and a pressure or suction means for the printing head. Examples of the preliminary auxiliary system are a preliminary heating means utilizing electrothermal transducers or a combination of other heater elements and the electrothermal transducers, and a means for carrying out preliminary ejection of ink independently of the ejection for printing. These systems are effective for reliable printing.

The number and type of printing heads to be mounted on a printing apparatus can be also changed. For example, only one printing head corresponding to a single color ink, or a plurality of printing heads corresponding to a plurality of inks different in color or concentration can be used. In other words, the present invention can be effectively applied to an apparatus having at least one of the monochromatic, multicolor and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. The present invention is most effective when it uses the film boiling phenomenon to expel the ink.

Furthermore, the ink jet printing apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing apparatus using a printing head in which a plurality of printing elements are arranged, to perform printing on a printing medium based on print data assigned to a plurality of printing elements comprising:

deviation calculating means for, for a plurality of printing elements, calculating a deviation amount in an arrangement direction of the plurality of printing elements based on a predetermined amount of print data, the deviation of printing elements being caused by thermal expansion of the printing head; and assigning means for, for each of a plurality of printing-element groups which are established by distinguishing the plurality of printing elements by respective predetermined deviation amounts as references on a basis of the deviation amount of each of said plurality of printing elements calculated by said deviation calculating means, shifting the print data to be assigned to other printing elements by an amount corresponding to the predetermined deviation amount of said printing element group and performing assignments of the shifted print data to the printing elements in said group.

2. The printing apparatus according to claim 1, wherein the printing head is configured by arranging printing elements at a certain arrangement interval, and said assigning means divides respective deviation amounts of the plurality of printing elements calculated by said deviation calculating means by the arrangement interval, makes the printing elements having the same quotient obtained in said division belong to the same printing element group, makes the printing element having the smallest remainder obtained in said division among the printing elements of the same printing element group be a boundary position, assigns data as a logical sum of data for two successive printing elements to the boundary position, and assigns the shifted data for subsequent printing elements by the amount corresponding to the quotient to the other printing elements.

3. The printing apparatus according to claim 1, wherein when a printing-element number is provided for each printing element from one end to the other end of the printing head in order and the assigning means uses a boundary position having a quotient integer value k as the kth boundary position among the boundary positions and the printing-element number of a printing element at the kth boundary position is assumed as s, the data assigned to the kth boundary position is used as the logical sum between the data for a printing element having a printing-element number (s+k) obtained by adding k to the printing-element number s at the kth boundary position, and the data for a printing element having a printing-element number (s+k−1) obtained by adding (k−1) to the printing-element number s, and data assigned from the printing element having the printing-element number (s+1) up to the printing element immediately before the (k+1)th boundary position are respectively used as the data for a printing-element number obtained by adding k to the printing-element number of its own.

4. The printing apparatus according to claim 1, wherein when the printing head prints data on a printing medium at every column of the printing elements, dividing the data to be printed in the printing order for every column of printing elements, using one of the columns as a raster, and providing a raster number for each raster in the printing order, said assigning means, when the raster numbers are even, uses the data assigned to the kth boundary position as the logical sum between the data for a printing element having a printing-element number (s+k) obtained by adding k to the printing-element number s at the kth boundary position and the data for a printing element having a printing-element number (s+k−1) obtained by adding (k−1) to the printing-element number s and uses each of data values assigned from the printing element having the printing-element number (s+1) up to the printing element immediately before the (k+1)th boundary position as the data for a printing-element number obtained by adding k to the printing-element number of its own, and said assigning means, when the raster numbers are odd, uses the data assigned to the printing element immediately before the kth boundary position as the logical sum between the data for a printing element having a printing-element number (s+k−1) obtained by adding (k−1) to the printing-element number s at the kth boundary position and the data for a printing element having a printing-element number (s+k−2) obtained by adding (k−2) to the printing-element number s, and uses each of data values assigned to printing elements from the kth boundary position up to the last position but one before the (k+1) boundary position as the data for a printing-element number obtained by adding k to the printing-element number of its own.

5. The printing apparatus according to claim 1, wherein when a number of rasters which can be continuously processed is assumed as the number of raster units n and a remainder obtained by dividing a raster number by the number of raster units n is assumed as m, said assigning means, in the case of a raster number with the remainder m, uses the data assigned to the kth boundary position as the logical sum between the data for a printing element having a printing-element number (s+k−m) obtained by adding (k−m) to the printing-element number s at the kth boundary position and the data for a printing element having a printing-element number (s+k−1−m) obtained by adding ((k−1)−m) to the printing-element number s and uses each of data values assigned to printing elements from the printing element having a printing-element number (s+1) up to the printing element immediately before the (k+1)th boundary position as the data for a printing-element number obtained by adding k to the printing-element number of its own.

6. The printing apparatus according to claim 1, wherein said assigning means performs the processing for shifting the data to be assigned to other printing elements by a value corresponding to a predetermined shift value for each of a plurality of printing element groups distinguished on the basis of the predetermined shift value in accordance with the shift value of each of the printing elements obtained by the deviation calculating means by using an address shift circuit for shifting the address storing the data for each printing element.

7. The printing apparatus according to claim 1, wherein the printing elements produce bubbles in the ink near the printing elements by using thermal energy and eject the ink by pressure of the produced bubbles.

8. A printing method using a printing head in which a plurality of printing elements are arranged to perform printing on a printing medium based on print data assigned to a plurality of printing elements, comprising:

a deviation calculating step for, for a plurality of printing elements, calculating a deviation amount in an arrangement direction of the plurality of printing element based on a predetermined amount of print data, the deviation of printing elements being caused by thermal expansion of the printing head; and an assigning step for, for each of a plurality of printing-element groups which are established by distinguishing the plurality of printing elements by respective predetermined deviation amounts as references on a basis of the deviation amount of each of said plurality of printing elements calculated by said deviation calculating step, shifting the print data to be assigned to other printing elements by an amount corresponding to the predetermined deviation amount of said printing element group and performing assignments of the shifted print data to the printing elements in said group.

9. The printing method according to claim 8, wherein when it is assumed that the printing head is configured by arranging printing elements at a certain arrangement interval, said assigning step divides respective deviation amounts of the plurality of printing elements calculated by said deviation calculating step by the arrangement interval, makes the printing elements having the same quotient obtained in said division belong to the same printing element group, makes the printing element having the smallest remainder obtained in said division among the printing elements of the same printing element group be a boundary position, assigns data as a logical sum of data for two successive printing elements to the boundary position, and assigns the shifted data for subsequent printing elements by the amount corresponding to the quotient to the other printing elements.

10. The printing method according to claim 8, wherein when a printing-element number is provided for each printing element from one end to the other end of the printing head in order, and said assigning step assumes a boundary position in which the integer value of the quotient is equal to k as the kth boundary position and the printing-element number of a printing element serving as the kth boundary position as s, the data assigned to the kth boundary position is used as the logical sum between the data for a printing element having a printing-element number (s+k) obtained by adding k to the printing-element number s at the kth boundary position and the data for a printing element having a printing-element number (s+k−1) obtained by adding (k−1) to the printing-element number s, and each of data values assigned to printing elements from the printing element having a printing-element number (s+1) up to the printing element immediately before the (k+1)th boundary position is used as a data value for a printing-element number obtained by adding k to the printing-element number of its own.

11. The printing method according to claim 8, wherein when the printing head prints data in a printing medium at every column of the printing elements, data values to be printed are divided for every column of printing elements in the printing order, one of the columns is used as a raster, and a raster number is provided for each raster in the printing order, said assigning step, when the raster numbers are even, uses the data assigned to the kth boundary position as the logical sum between the data for a printing element having a printing-element number (s+k) obtained by adding k to the printing-element number s at the kth boundary position and the data for a printing element having a printing-element number (s+k−1) obtained by adding (k−1) to the printing-element number s and uses each of data values assigned to printing elements from the printing element having a printing-element number (s+1) up to the printing element immediately before the (k+1)th boundary position as the data for a printing-element number obtained by adding k to the printing-element number of its own, and said assigning step, when the raster numbers are odd, uses the data assigned to the printing element immediately before the kth boundary position as the logical sum between the data for a printing element having a printing-element number (s+k−1) obtained by adding (k−1) to the printing-element number s at the kth boundary position and the data for a printing element having a printing-element number (s+k−2) obtained by (k−2) to the printing-element number s and uses each of data values assigned to printing elements from the printing element at the kth boundary position to two numbers before the (k+1)th boundary position as the data for a printing-element number obtained by adding k to the printing-element number of its own.

12. The printing method according to claim 8, wherein when a number of raster which can be continuously processed in assumed as the number of raster units n and a ramainder obtained by dividing a raster number by the number of raster units n as m, said assingning step, in the case of a raster number with the remainder m, uses the data assigned to the kth boundary position as the logical sum between the data for a printing element having a printing-element number (s+k−m) obtained by adding (k−m) to the printing-element number s at the kthe boundary position and the data for a printing element having a printing-element number (s+k−1−m) obtained by adding ((k−1)−m) to the printing-element number s and uses each of data values assigned to printing elements from the printing element having a printing-element number (s+1) up to a printing element immediately befor the (k+1)th boundary position as the data for a printing element number obtained by adding k to the printing-element number of its own.

* * * * *

UNITED STATES PATENT AND TRADEMARK OFFICE

CERTIFICATE OF CORRECTION

PATENT NO. : 6,315,378 B1
DATED : November 13, 2001
INVENTOR(S) : Yoshida

It is certified that error appears in the above-identified patent and that said Letters Patent is hereby corrected as shown below:

Column 1,
Line 50, "AL" should read -- $\Delta L$ --.
Line 51, "$23.1\times10^{-}$" should read -- $23.1\times10^{-6}$ --.
Line 52, "$_{6}(\text{deg})^{-1}$." should read -- $(\text{deg})^{-1}$. --.

Column 18,
Line 25, "raster" should read -- rasters --.
Line 26, "in" should read -- is --.
Line 27, "ramainder" should read -- remainder --.
Line 34, "kthe" should read -- kth --.
Line 40, "befor" should read -- before --.

Signed and Sealed this

Twenty-first Day of May, 2002

*Attest:*

*Attesting Officer*

JAMES E. ROGAN
*Director of the United States Patent and Trademark Office*